US006740229B2

(12) United States Patent
Nascimento et al.

(10) Patent No.: US 6,740,229 B2
(45) Date of Patent: May 25, 2004

(54) METHOD FOR DRYING THE CHARGE FROM A UNIT THAT TREATS PETROLEUM CUTS WITH A LOW WATER CHARGE

(75) Inventors: Pedro Nascimento, Le Havre (FR); Jacques Couillard, Le Havre (FR); Jean-Louis Mauleon, Sainte Croix sur Aizier (FR); Alain Milan, Montivilliers (FR)

(73) Assignee: Total Raffinage Distribution S.A., Puteaux (FR)

( * ) Notice: Subject to any disclaimer, the term of this patent is extended or adjusted under 35 U.S.C. 154(b) by 0 days.

(21) Appl. No.: 10/187,965

(22) Filed: Jul. 3, 2002

(65) Prior Publication Data

US 2003/0006169 A1 Jan. 9, 2003

(30) Foreign Application Priority Data

Jul. 5, 2001 (FR) ..... 01 08934

(51) Int. Cl.[7] ..... C10G 33/04
(52) U.S. Cl. ..... 208/188; 208/187
(58) Field of Search ..... 208/187, 188

(56) References Cited

U.S. PATENT DOCUMENTS 4,002,558 A 1/1977 Feldman

FOREIGN PATENT DOCUMENTS

| | | |
|---|---|---|
| GB | 807200 | 1/1959 |
| GB | 1426401 | 2/1976 |

*Primary Examiner*—Walter D. Griffin
*Assistant Examiner*—James Arnold, Jr.
(74) *Attorney, Agent, or Firm*—Sughrue Mion, PLLC

(57) ABSTRACT

This invention relates to a method for drying the charge of a unit that treats petroleum cuts with a low water charge that consists in injecting a hydrolysable chemical compound into said charge.

The quantity of the chemical compound injected is at least equal to the quantity necessary for all the water contained in the charge to react by hydrolysis with said chemical compound.

The invention finds its application in units that treat petroleum cuts and whose operation is sensitive to the presence of water in their charges, in particular the paraffin base hydrocarbon isomerisation units. One drawing.

11 Claims, 1 Drawing Sheet

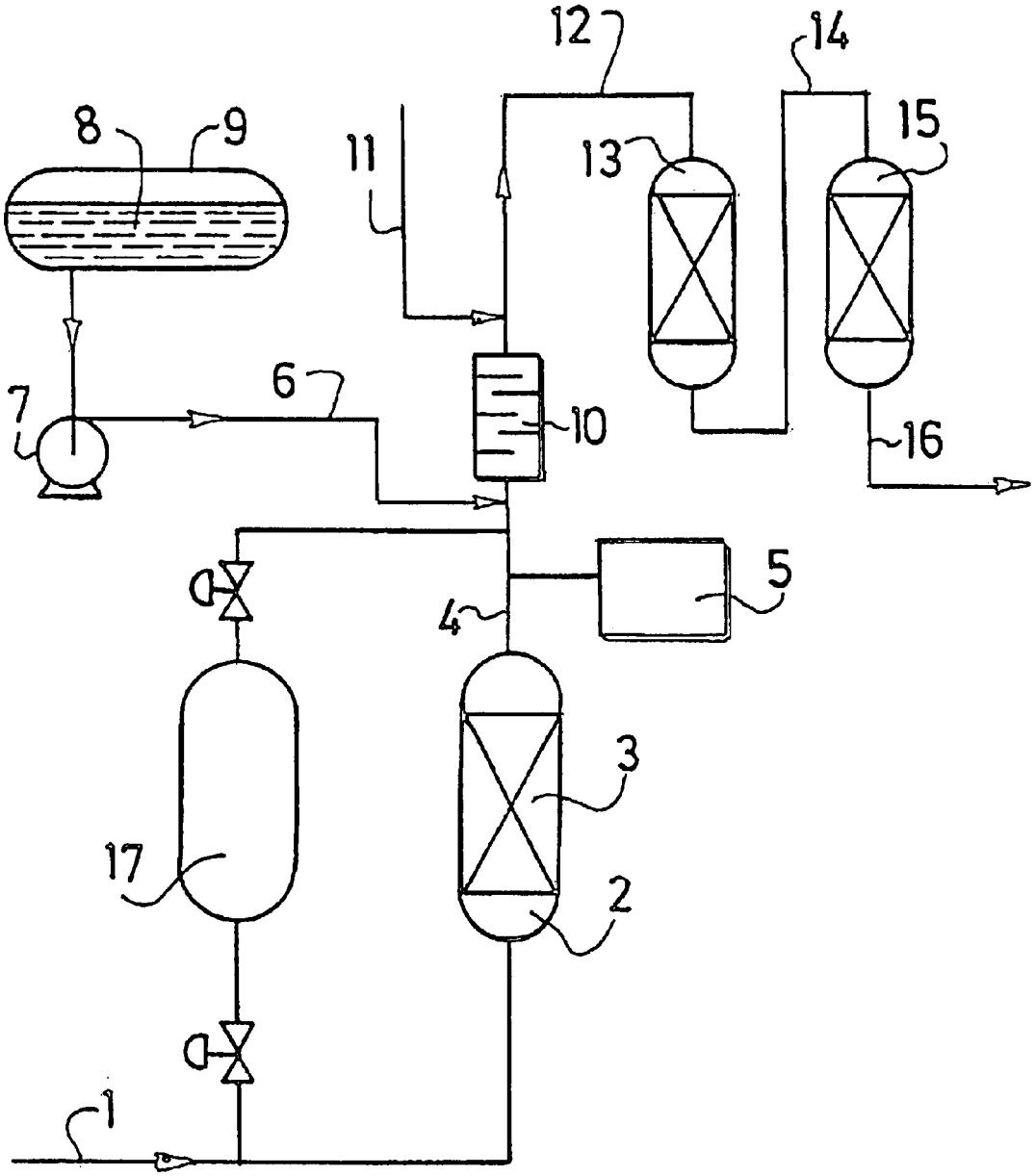
12
14
8
9
11
13
15
7
6
10
16
5
4
3
17
2
1

METHOD FOR DRYING THE CHARGE FROM A UNIT THAT TREATS PETROLEUM CUTS WITH A LOW WATER CHARGE

TECHNICAL ASPECT

This invention relates to the drying of petroleum cuts with a low water charge that are to be treated in units whose operation is sensitive to the presence of water in their charges.

STATUS OF THE PRIOR TECHNIQUE

A method for reducing the quantity of water in the charge of an isomerisation unit for paraffin base hydrocarbons with a water content that ranges between 0.5 and 5 ppm, is described in the British document GB 1 426 401 A dated Feb. 25, 1976.

According to this method, to reduce the water content to below 0.5 ppm, the paraffin base hydrocarbon charge is put in contact with a solid drying chemical agent whose active surface ranges between 1 and 500 $m^2/g$.

The dried charge is then isomerized at a temperature ranging between 50 and 350° C., in the presence of hydrogen, by passing over a catalyst.

According to one of the methods of execution of this method, the drying chemical agent is a support that is chemically inert to water, on the surface of which are deposited chemical compounds that easily combine with water. The chemical compounds can he either alkaline metals, such as potassium or sodium, or easily hydrolysable metallic chlorides, such as aluminum chloride.

This method has the disadvantage of needing costly and voluminous equipment that is hard to install on existing units in order to be implemented.

Furthermore, when the solid chemical agent has reacted with the water from the hydrocarbon charge, it cannot be regenerated and must be replaced.

Another method for drying a hydrocarbonic charge consists in passing said charge in dryers through a bed of adsorbent product that holds the water back through molecular interaction.

The adsorbent product is usually alumina or a molecular sieve. It progressively saturates with water and must be periodically regenerated.

Generally, two dryers are arranged parallel to each other where one is in regeneration mode while the other is carrying out the drying.

When the hydrocarbonic charge is passing through the dryer, the water is contains is adsorbed over a transfer area, that moves from the entry point to the exit point of the dryer as the adsorbent becomes saturated.

The width of this transfer area depends on the operating conditions, the periodicity of the regeneration of the adsorbent and of its aging.

At the beginning of the adsorption cycle, the transfer area is close to the entry point of the dryer and the water content of the charge when it exits is very low. At the end of the adsorption phase, the transfer area is close the to the exit point of the dryer and it could happen that the charge then only encounters adsorbent saturated with water.

This phenomenon results in a very rapid increase of the charge's water content at the dryer's exit point.

As the detection limit of the devices that measure the charge's water content is in the 0.1 ppm by weight range, when such a content is detected, the operation of the hydrocarbonic charge treatment unit has already experienced harmful effects, such as a significant deactivation of the catalyst in the case of an isomerisation unit.

DISCLOSURE OF THE INVENTION

The object of this invention is precisely to correct said disadvantages and provide an economic, efficient and safe method for drying a hydrocarbonic charge.

With this end in view, it proposes a method for drying a charge from a unit that treats petroleum cuts with a low water charge, characterized in that this charge is injected with a quantity of a chemical compound chosen from the group consisting of:

- a metal halide replaced by hydrocarbonic radicals with a formula of $M1X_yR1_nR2_m$ where M1 is a metal chosen from the group consisting of aluminum, gallium and indium, X is a halogen, R1 and R2 are hydrocarbonic radicals, the value or y is 1, 2 or 3, and the values of m and n are either 0 or 1, the sum of n and m is not equal to zero and the sum of y, n and m is equal to 3,
- a metal halide replaced by hydrocarbonic radicals with a formula of $M2X_zR1_jR2_kR3_l$ where M2 is a metal chosen from the group consisting of titanium, tin, germanium and zirconium, X is a halogen, R1, R2 and R3 are hydrocarbonic radicals, the value of z is 1 or 2 and the values of j, k and l are either 0 or 1, the sum of j, k and l is not equal to zero, and the sum of z, j, k and 1 is equal to 4,
- a metal compound replaced by hydrocarbonic radicals with a formula of M3R1R2R3R4 where M3 is a metal chosen from the group consisting of titanium, tin, germanium and zirconium, and R1, R2 and R3 are hydrocarbonic radicals,
- a metal compound replaced by hydrocarbanic radicals with a formula of M4R1R2R3 where M4 is a metal chosen from the group consisting of aluminum, gallium and indium, R1, R2 and R3 arc hydrocarbonic radicals where the quantity of the chemical compound injected is at least equal to the quantity necessary for all the water contained in said charge to react by hydrolysis with said chemical compound.

The hydrocarbonic radicals R1, R2, R3 and R4 are preferably chosen from the alkyl or aryl groups.

When the water content of the charge, expressed by weight, is less that 1 ppm, the quantity of chemical compound injected is advantageously less than 1% by weight of said charge.

Preferably, the quantity of chemical compound injected is less than 100 ppm by weight and, even more preferably, less than 1 ppm by weight of said charge.

In a preferred mode of execution, the method of the invention is implemented by previously diluting the quantity of chemical compound injected in at least a hydrocarbon.

The hydrocarbon for the dilution can namely be chosen from the paraffin base hydrocarbons that contain 5 or 6 carbon atoms.

Alternatively, the hydrocarbon for the dilution can be chosen from the naphthenic hydrocarbons that contain 5 or 6 carbon atoms.

When the unit that treats the petroleum cut is an isomerisation unit that consists of a section that dries the charge and a reaction section, linked by a connecting pipe, the chemical compound can be injected into said connection.

Lastly, in this form of implementation, the connecting pipe can advantageously be provided with a mixing device arranged downstream from the point of injection of the chemical compound.

Therefore, the device in the invention provides an economical and efficient means for drying hydrocarbon charges at the entry point of treatment units that are sensitive to the presence of water.

On the one hand, it does not require that the refineries make any significant additional investments. On the other hand, the chemical compounds injected into the hydrocarbon charge according to the method as set forth in the invention hold hydrocarbon radicals that allow them to better solubilize in the charge and therefore make it easier to improve the sought dehydration.

BRIEF DESCRIPTION OF THE DRAWINGS

Such a form of implementation of the invention will be described hereafter in further detail, by referring to FIG. 1 of the attached drawing, which schematically represents a gasoline isomerisation unit, whose charge is dried as according to the method as described in the invention.

DETAILED DISCLOSURE OF THE INVENTION

The unit schematically represented in FIG. 1 is an isomerisation unit for a petroleum cut that contains paraffin base hydrocarbons with 5 or 6 carbon atom and whose water content is less than 50 ppm by weight.

The petroleum cut to be isomerized arrives through line 1 in the drier 2 that encloses the molecular sieve 3.

As is passes through said drier 2, the oil fraction is put in contact with the molecular sieve 3 that adsorbs the majority of the water it contains.

At the exit point 4 of the drier 3, the residual water content is measured using a hygrometer 5.

According to a preferred method of execution of the method as set forth in the invention, downstream from the hygrometer 5 measuring, a mixture 8 of aluminum ethyl dichloride ($AlCl_2C_aH_5$) and hydrocarbons containing 5 or 6 carbon atoms contained in a reservoir 9 is injected through line 6 into line 4, using a pump 7.

The aluminum ethyl dichloride and hydrocarbon mixture is added to the charge that circulates in line 4 to feed a static mixer 10, whose exit point is linked by line 12 to the entry point of a first isomerisation reactor 13, that enclosed a catalyst composed of highly chlorinated alumina (chlorine content greater than 3% by weight) and platinum.

Dry hydrogen is injected through line 11 into line 12, between the exit point of the drier 3 and the entry pint of the reactor 13.

The exit point of said first reactor 13 is linked by line 14 to the entry point of a second isomerisation reactor 15, charged with a catalyst identical to the catalyst of the first reactor 13. The treated charge is evacuated from the reactor 15 through line 16.

The isomerisation unit is also comprised of a backup regenerated drier 17 and, not represented in FIG. 1, of means of commuting the two driers 3 and 17, as well as of means of subjugating the flow of the aluminum ethyl dichloride and hydrocarbon mixture in line 6 to the flow of the charge in line 4, to ensure that both said flows are proportionate.

The aluminum ethyl dichloride diluted in the hydrocarbons injected through line 6 into line 4 reacts through hydrolysis with the residual water contained in the charge exiting the drier 3, in particular in the mixer 10, and, as its passes in line 12, it also reacts with the traces of water possibly carried by the injected hydrogen.

To be sure that any trace of water that is less than a given threshold in the charge is eliminated before it enters the reactor 13, we inject a quantity of aluminum ethyl dichloride that is greater, for example, than 20% of the quantity that is absolutely required to eliminate said traces, where said quantity matches the stoichiometric quantity necessary to carry out the total hydrolysis of the aluminum ethyl dichloride, determined using the following chemical equation:

$$AlCl_2C_2H_5—3H_2O—Al(OH_3—C_2H_6+2IICl$$

Thanks to the invention, it is possible to eliminate the traces of water smaller than a given value in the charge, before it enters the reactors, while allowing for a margin of safety, and thus maintaining the activity of the catalyst at its best level.

It is also possible to eliminate the temporary peaks of water content subsequent to the saturation of the molecular sieve in the drier, for example, the time needed to cut the feeding of charge to the drier 2, or to switch to the second regenerated drier 17.

This invention also has the advantage of making possible the elimination of polluting products, such as hydrogen sulfide, mercaptans and alcohols, by having them react with the injected chemical compound according to the following general chemical equations:

$$AlCl_2R+3HY \rightarrow AlY_3+RIl+2HCl$$

$$AilR_3+3HY \rightarrow AlY_3+3RH$$

where Y represents on of the following radicals: —OII, —OR, —Cl, —SH, —SR.

The invention is not limited to the injection of aluminum ethyl dichloride to dry a petroleum cut that is to be isomerized, but, as set forth in other modes of execution available to the man of the art of the invention, it makes it possible to dry many other types of petroleum cuts and, in particular, the charges of alkylation units of the solid type.

What is claimed is:

1. Method for drying the charge of a unit that treats petroleum cuts with a low water charge, comprising a step of infecting into said charge a quantity of a chemical compound which is soluble in said charge chosen from the group consisting of:

a metal halide replaced by hydrocarbonic radicals with a formula of $M1X_yR1_nR2_m$ where M1 is a metal chosen from the group consisting of aluminum, gallium and indium, X is a halogen, R1 and R2 are hydrocarbonic radicals, the value of y is 1, 2 or 3 and the values of m and n are 0 or 1, the sum of n and m is not equal to zero and the sum of y, n and m is equal to 3, a metal halide replaced by the hydrocarbonic radicals with a formula of $M2X_zR1_jR2_kR3_l$, where M2 is a metal chosen from the group consisting of titanium, tin, germanium and zirconium, X is a halogen, R1, R2 and R3 are hydrocarbonic radicals, the value of z is 1 or 2 and the values of j, k and l are 0 or 1, the sum of j, k and 1 is not equal to zero and the sum of z, j, k and l is equal to 4, a metal compound replaced by hydrocarbonic radicals with a formula of M3R1R2R3R4, where M3 is a metal chosen from the group consisting of titanium, tin, germanium, and zirconium and R1, R2, R3 and R4 are hydrocarbonic radicals, a metal compound replaced by hydrocarbonic radicals with a formula of M4R1R2R3 where M4 is a metal chosen from the group consisting of aluminum, gallium and indium and R1, R2 and R3 are hydrocarbonic radicals, where the quantity of the chemical compound injected is at least equal to the quantity necessary for all the water contained in said charge to react by hydrolysis with said chemical compound.

2. Method as set forth in claim 1, characterized in that the hydrocarbonic radicals R1, R2, R3 and R4 are chosen from the alkyl or aryl groups.

3. Method as set forth in claim 1, characterized in that the chemical compound injected into the charge is aluminum ethyl dichloride.

4. Method as set forth in claim 1, characterized in that the water content of the charge is less than 1 ppm expressed by weight, the quantity of the chemical compound injected is less than 1% by weight of said charge.

5. Method as set forth in claim 4, characterized in that the quantity of the chemical compound injected is less than 100 ppm by weight of said charge.

6. Method as set forth in claim 1, characterized in that the quantity of chemical compound injected is previously diluted in at least a hydrocarbon.

7. Method as set forth in claim 6, characterized in that the dilution hydrocarbon is chosen from the paraffin base hydrocarbons that contain 5 or 6 carbon atoms.

8. Method as set forth in claim 6, characterized in that the dilution hydrocarbon is chosen from the naphthenic hydrocarbons that contain 5 or 6 carbon atoms.

9. Method as set forth in claim 1, characterized in that the treatment unit is an isomerisation unit comprised of a drying section (2, 17) of the charge and a reaction section (13, 15) linked by a connecting pipe (4), where the chemical compound is injected into said connection (4).

10. Method as set forth in claim 9, characterized in that the chemical compound is injected in the connecting pipe (4) upstream from a mixing device (10) equipped with said connecting pipe (4).

11. Method as set forth in claim 5, characterized in that the quantity of the chemical compound injected is less than 1 ppm by weight of said charge.

* * * * *